US008309785B2

(12) United States Patent
Larsson et al.

(10) Patent No.: US 8,309,785 B2
(45) Date of Patent: Nov. 13, 2012

(54) DISPOSAL DEVICE AND METHOD OF DISPOSAL FOR BODY FLUID COLLECTING BAGS

(75) Inventors: Olle Larsson, Zug (CH); Michael Larsson, Zug (CH); Lukas Christen, Luzern (CH)

(73) Assignee: Medela Holding AG, Baar (CH)

( * ) Notice: Subject to any disclaimer, the term of this patent is extended or adjusted under 35 U.S.C. 154(b) by 763 days.

(21) Appl. No.: 12/526,929

(22) PCT Filed: Feb. 1, 2008

(86) PCT No.: PCT/CH2008/000038
§ 371 (c)(1),
(2), (4) Date: Aug. 12, 2009

(87) PCT Pub. No.: WO2008/098385
PCT Pub. Date: Aug. 21, 2008

(65) Prior Publication Data

US 2010/0010286 A1 Jan. 14, 2010

(30) Foreign Application Priority Data

Feb. 14, 2007 (CH) ..... 241/07

(51) Int. Cl.
*A62D 3/40* (2007.01)

(52) U.S. Cl. ..... 588/321; 422/309

(58) Field of Classification Search ..... 588/321, 588/306, 307, 309, 313, 405, 900; 422/309
See application file for complete search history.

(56) References Cited

U.S. PATENT DOCUMENTS 6,293,318 B1 9/2001 Schmidt et al.

FOREIGN PATENT DOCUMENTS

| | | | |
|---|---|---|---|
| DE | 19514467 | A1 | 10/1996 |
| EP | 0579051 | A2 | 1/1994 |
| EP | 1076008 | A | 2/2001 |
| EP | 1462375 | A | 9/2004 |
| WO | 83/02722 | A1 | 8/1983 |

*Primary Examiner* — Edward Johnson
(74) *Attorney, Agent, or Firm* — McDonnell Boehnen Hulbert & Berghoff LLP

(57) ABSTRACT

A disposal device for collecting bags for bodily fluids has a receptacle for receiving at least one collecting bag containing bodily fluid, a comminution unit (2) for comminuting the collecting bag, a fluid collecting basin (5) for receiving the bodily fluid, a particle collecting container (8) for receiving the comminuted collecting bag, and at least one decontamination unit (7) for the decontamination of the collecting bag and the bodily fluid.

21 Claims, 7 Drawing Sheets

DISPOSAL DEVICE AND METHOD OF DISPOSAL FOR BODY FLUID COLLECTING BAGS

TECHNICAL FIELD

The invention relates to a disposal device for body fluid collecting bags and to a method for the disposal of such collecting bags.

PRIOR ART

In the medical field there are various collecting bags in which body fluids are collected and which require disposal. Examples of these are drainage bags, blood transfusion bags, urine bags and secretion bags.

These bags are usually incinerated in their entirety. However, in an extremely simple type of disposal the bag is perforated and the body fluid is removed and usually discharged into the sewage system. The bag is flushed with a disinfecting fluid before it is also passed on to form part of the normal hospital refuse.

Devices for perforating and flushing out the bags are known. An example of this is WO 2004/028907. DE 299 17 005, DE 299 17 006, DE 199 46 140 and DE 199 46 141 also disclose systems for automatically opening bags filled with fluids.

However, the known systems have the disadvantage that the bags have to be precisely positioned and/or manually introduced. The bag must also be manually removed again. Furthermore, at least some of the materials leaving the bags are still contaminated.

SUMMARY OF THE INVENTION

It is therefore an object of the invention to provide a device and a method for the disposal of collecting bags containing body fluids that make uncomplicated handling possible and optimize decontamination.

This object is achieved by a device with the features of patent claims 1 and 13 and by a method with the features of patent claim 14.

The disposal device for body fluid collecting bags according to the invention has a receptacle for receiving at least one collecting bag comprising body fluid or filled with body fluid, a comminution unit for comminuting the collecting bag, a particle collecting container for receiving the comminuted collecting bag and at least one decontamination unit for the decontamination or sterilizing treatment of the collecting bag and the body fluid.

Furthermore, there is preferably a fluid collecting basin for receiving the body fluid. The comminution of the bag preferably takes place by cutting the bag up into pieces and/or melting or incinerating it.

In another variant, the disposal device for body fluid collecting bags according to the invention has a receptacle for receiving at least one collecting bag comprising body fluid, a fluid collecting basin (5) for receiving the body fluid and at least one decontamination unit (7) for the decontamination of the body fluid.

The method for the disposal of a body fluid collecting bag according to the invention has the following steps:

comminuting the collecting bag, collecting the body fluid separately from the comminuted collecting bag and decontaminating the comminuted collecting bag and the collected body fluid.

The decontamination or disinfection or sterilization preferably takes place by means of irradiation with gamma rays and/or UV light. As an alternative or in addition, heating may also be used. Furthermore, chemical decontamination in dry and wet processes is also possible. The fluid may also be sterile-filtered.

The collecting bag and the collected body fluid are preferably decontaminated separately from each other, wherein the treatment preferably takes place simultaneously. The same decontamination unit is preferably used for this.

The emptied, but otherwise still intact and/or already comminuted, in particular cut-up, collecting bag is preferably flushed with a cleaning or disinfecting fluid.

The device according to the invention makes disposal easier, since, once the bag has been introduced, nothing more has to be done manually. In preferred embodiments of the invention, there is no need for the bag to be placed or oriented when it is introduced into the device. The bag is merely thrown into the device; it is also possible for a number of bags to be thrown in simultaneously.

The decontamination or sterilization of the entire material, i.e. the material of the bag, the body fluid and the cleaning or disinfecting fluid, minimizes the risk to humans and the environment.

Since the bag is chopped up or comminuted in some other way, the amount of refuse is reduced.

Further advantageous embodiments and variants of the method are provided by the dependent patent claims.

BRIEF DESCRIPTION OF THE DRAWINGS

The subject matter of the invention is explained below on the basis of a preferred embodiment, which is represented in the accompanying drawings. The same parts are denoted by the same designations. In the drawing.

WAYS OF IMPLEMENTING THE INVENTION

Figure 1:
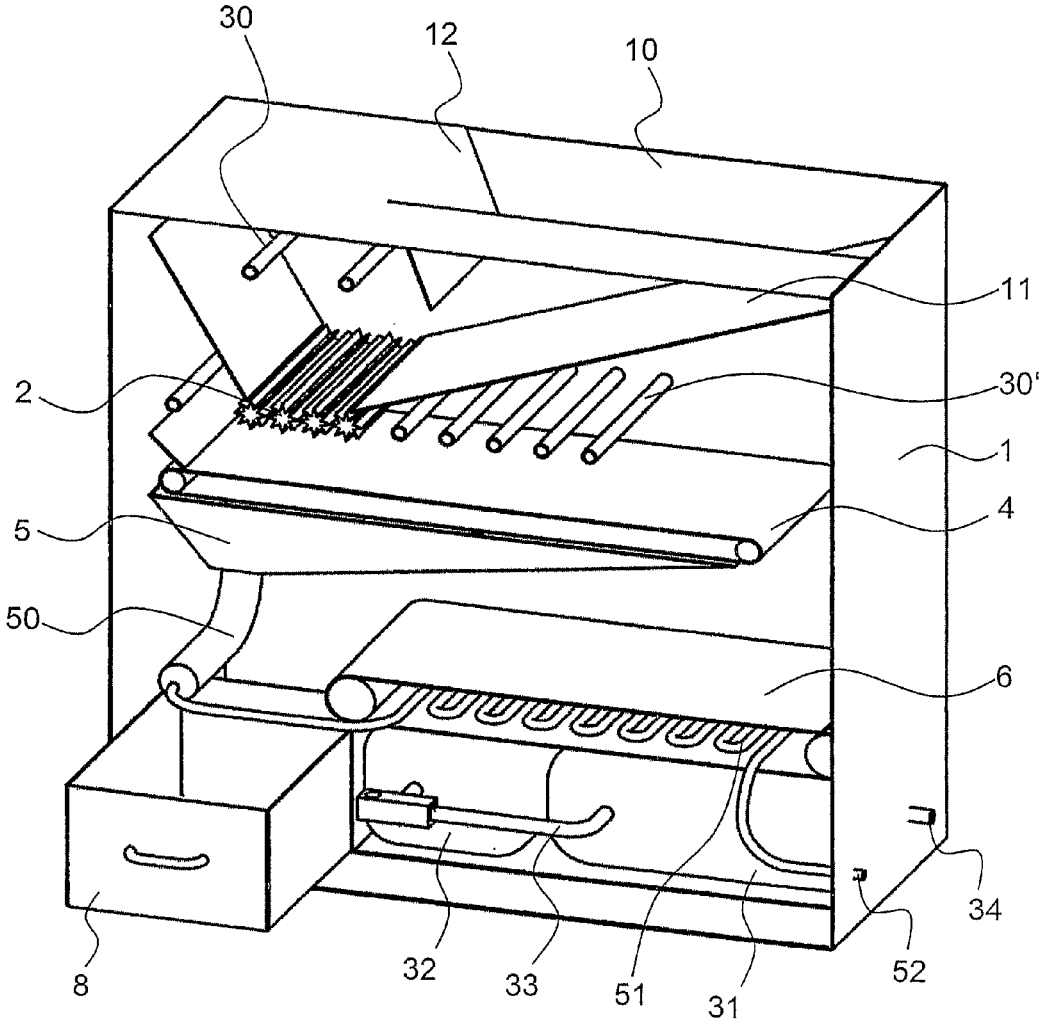
FIG. 1 shows a schematic perspective representation of the device according to the invention in a first embodiment.

As can be seen in FIG. 1, the device according to the invention has a housing 1, which encloses the individual elements of the device. The housing 1 is preferably made of metal or a plastic. Depending on the method of decontamination that is used, the housing is shielded from the outside.

The housing 1 has a filling opening 10 with an adjoining filling funnel 11, integrated in the housing, and with a baffle 12, delimiting this funnel 11. The baffle 12 holds up and guides the collecting bags, so that they can continue into the device individually or in an orderly form.

The filling opening 10 is preferably arranged in the upper wall of the housing 1. It may, however, also be arranged at the side and/or be provided with a filling funnel or channel arranged outside the housing. Instead of the inner filling funnel 11, a filling channel or some other element receiving the collecting bags that are to be emptied may also be present. In order to ensure optimum further transport of the collecting bag, the filling funnel 11 may be provided with a pusher or it may be equipped with a vibrating mechanism.

The funnel 11 ends in a comminution unit, in particular a chopper 2 or some other means suitable for cutting the collecting bag up into pieces.

Arranged underneath the chopper 2 is a first conveyor 4, preferably a fluid-permeable, continuously circulating conveyor belt. The first conveyor 4 preferably extends almost over the entire width of the housing 1 and preferably runs horizontally. The conveyor 4 may, for example, consist of a material in mesh form or have holes to allow the fluid to drip away.

Underneath this first conveyor 4 is a fluid collecting container 5, which is preferably designed in the form of a funnel. Its opening, directed upwardly toward the first conveyor, preferably extends over the entire conveying length of the first conveyor 4 and in its entirety over the entire width thereof, so that all of the fluid dripping from the first conveyor 4 can be collected in the fluid collecting container 5.

At its lower end, the fluid collecting container 5 goes over into an outflow line 50 part of which is made to follow a meandering form as a cleaning section 51. The outflow line 50 ends in an outlet opening 52, which passes through the housing 1.

Arranged underneath the first conveyor 4 and offset with respect thereto in the conveying direction is a second conveyor 6. This also preferably runs horizontally and is preferably formed as a continuously circulating conveyor belt. However, it is not necessary for it to be fluid-permeable and it may, for example, consist of an impermeable plastics material or a textile fabric.

The conveying direction of the second conveyor 6 preferably runs antiparallel to that of the first conveyor 4. The beginning of the conveying section of the second conveyor 6 is arranged at a distance downstream from the conveying section of the first conveyor 4, so that parts that are transported on the first conveyor 4 fall onto the second conveyor 6 and are transported further by the latter in the opposite direction.

The second conveyor 6 ends above a particle collecting container 8. This container 8 is preferably a drawer, which is preferably arranged in the lowermost region of the housing 1 and can be pulled out of the housing 1.

The aforementioned meandering cleaning section 51 runs parallel and underneath or above the second conveyor 6. It may also, as shown here, run in the second conveyor 6, in which case it is preferably located between the two strands of the second conveyor 6.

At least one decontamination unit, here a gamma radiation source 7, likewise extends along this second conveyor 6 and preferably almost over its entire length. This can be seen in particular in FIG. 3. To make the drawing easier to view, the radiation source 7 is not shown in FIG. 1. Instead of or in addition to the gamma radiation source, a UV light source, a heating unit or some other means suitable for decontamination, in particular contactless decontaminating means, can also be used.

The device also has a flushing unit 3, to flush or spray away the still not cut-up and/or already cut-up collecting bag. Arranged in the lower region of the housing 1 is a water tank or a boiler 31, which can be filled from the outside via a filling opening 34. Arranged alongside this boiler 31, and connected to it by means of a connecting line 33, is an additive tank 32. The boiler 31 heats up the water flowing in via the filling opening, preferably to around 60-70° C. The additive tank 32 can be filled with a cleaning agent or a disinfectant. It goes without saying that there may also be more tanks or fewer tanks. Moreover, the mixing of the cleaning fluid does not have to take place in the device itself, but rather it is also sufficient, for example, for there to be a single tank, which is filled with a suitable fluid or a mixture.

Figure 2:
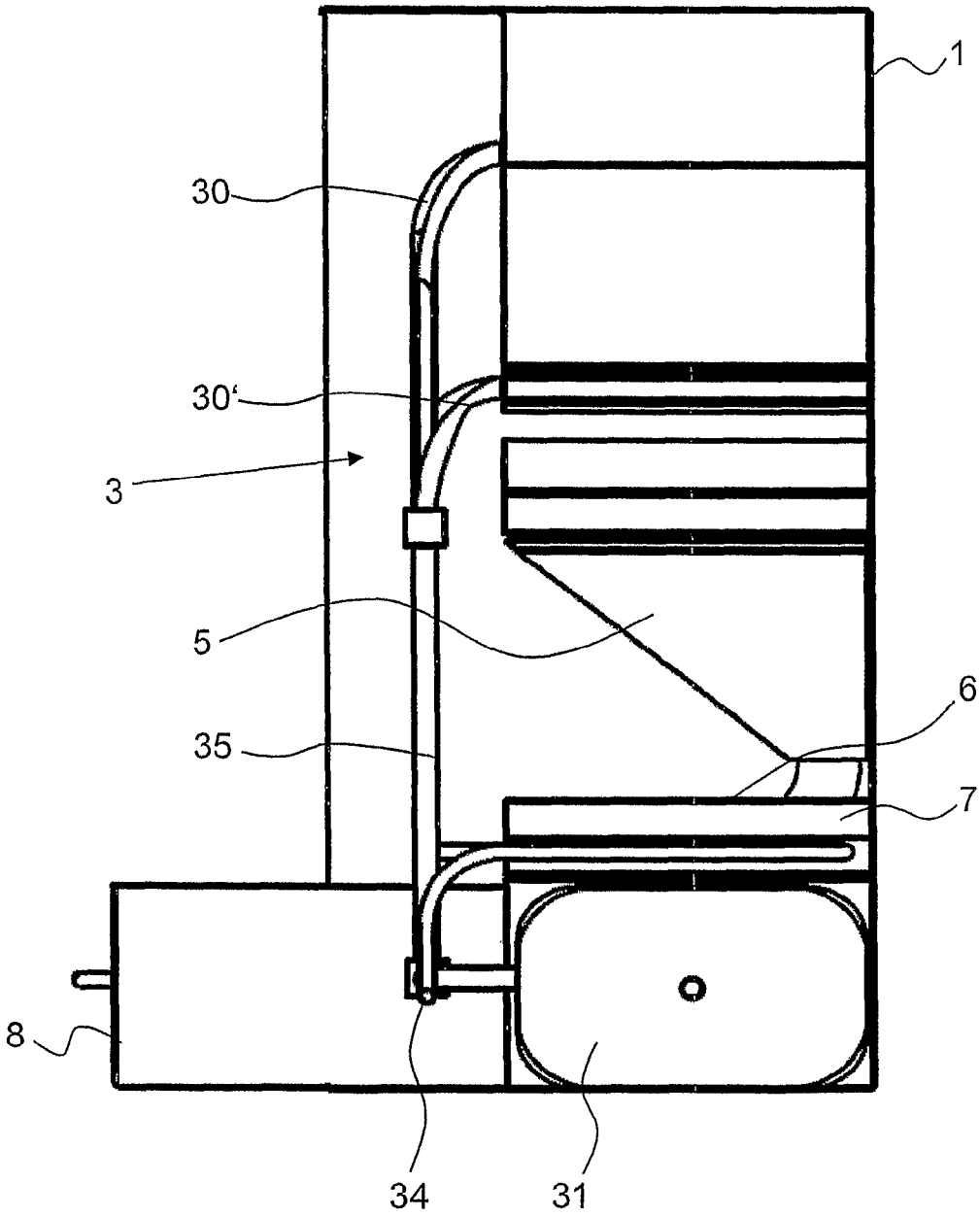
FIG. 2 shows a cross section through the device according to FIG. 1.
Figure 3:
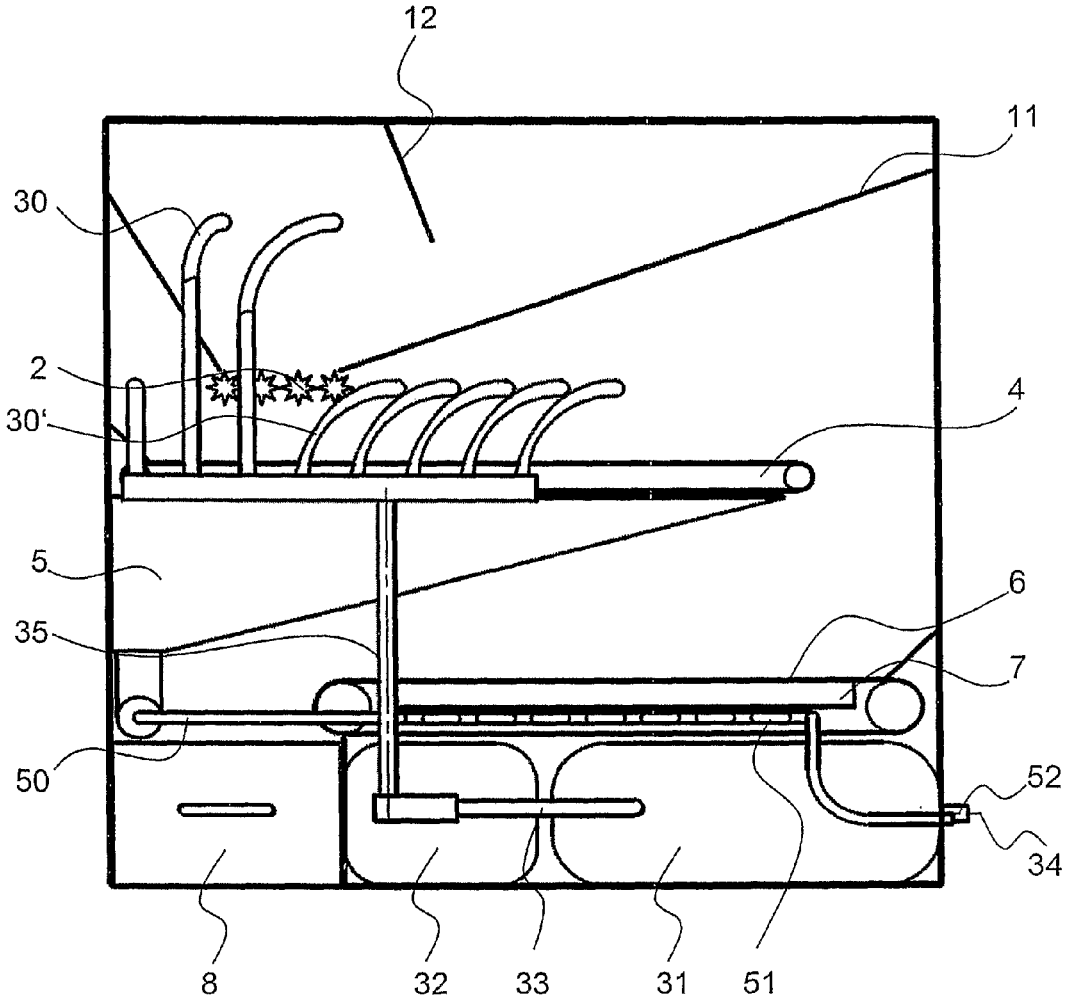
FIG. 3 shows a longitudinal section through the device according to FIG. 1.

From these tanks 31, 32, one or more feed lines 35 lead upward and end in spraying elements 30, 30', as can be seen in FIGS. 2 and 3. In the example represented here, the spraying elements 30, 30' are elongate spray nozzles with a slit or a number of holes arranged next to one another. The spray openings are preferably downwardly directed.

The spraying elements 30, 30' preferably extend transversely in relation to the conveying direction of the first conveyor 4. There are preferably upper spraying elements 30, which are arranged above the chopper 2 in the funnel 11, and lower spraying elements 30', which are located underneath said chopper, but still above the first conveyor 4.

There now follows a description of the operating mode of the device according to the invention:

The device is suitable for a wide variety of different types of collecting bags. However, it is preferably used for collecting bags which consist exclusively of a flexible material, for example of polyethylene (PE). Similarly, however, it is suitable for collecting bags with a part, in particular a cover, of a hard material. It is suitable in particular for drainage collecting bags with a rigid head part, such as for example those that have been sold for years by the applicant.

These collecting bags filled with fluid and requiring disposal are emptied into the filling funnel 11. From there, they pass of their own accord, one at a time or more than one at a time, to the chopper 2 via the filling funnel 11. In the chopper 2, the still filled bags are comminuted, wherein they are subjected, preferably from above, to the cleaning fluid sprayed out of the nozzles 30. The cut-up parts of the bag fall from the chopper 2 onto the first conveyor 4, wherein the body fluid contained therein and the cleaning fluid pass through the first conveyor 4 into the liquid collecting basin 5.

The parts of the bag are further transported by the first conveyor 4, wherein they are preferably still subjected or again subjected to a or the cleaning fluid. The cleaning fluid thereby flows out of the lower nozzles 30'.

At the end of the first conveyor 4, the parts fall onto the second conveyor 6 and along this section are exposed to gamma radiation, or irradiated with UV light, heated up and/or decontaminated by means of other methods.

At the same time, the collected fluid passes from the collecting basin 5 into the outflow line 50 and is likewise decontaminated along the cleaning section 51.

At the end of the second conveyor 6, the decontaminated parts fall into the particle collecting container 8. The decontaminated fluid is discharged from the housing 1 via the outlet opening 52.

Figure 4:
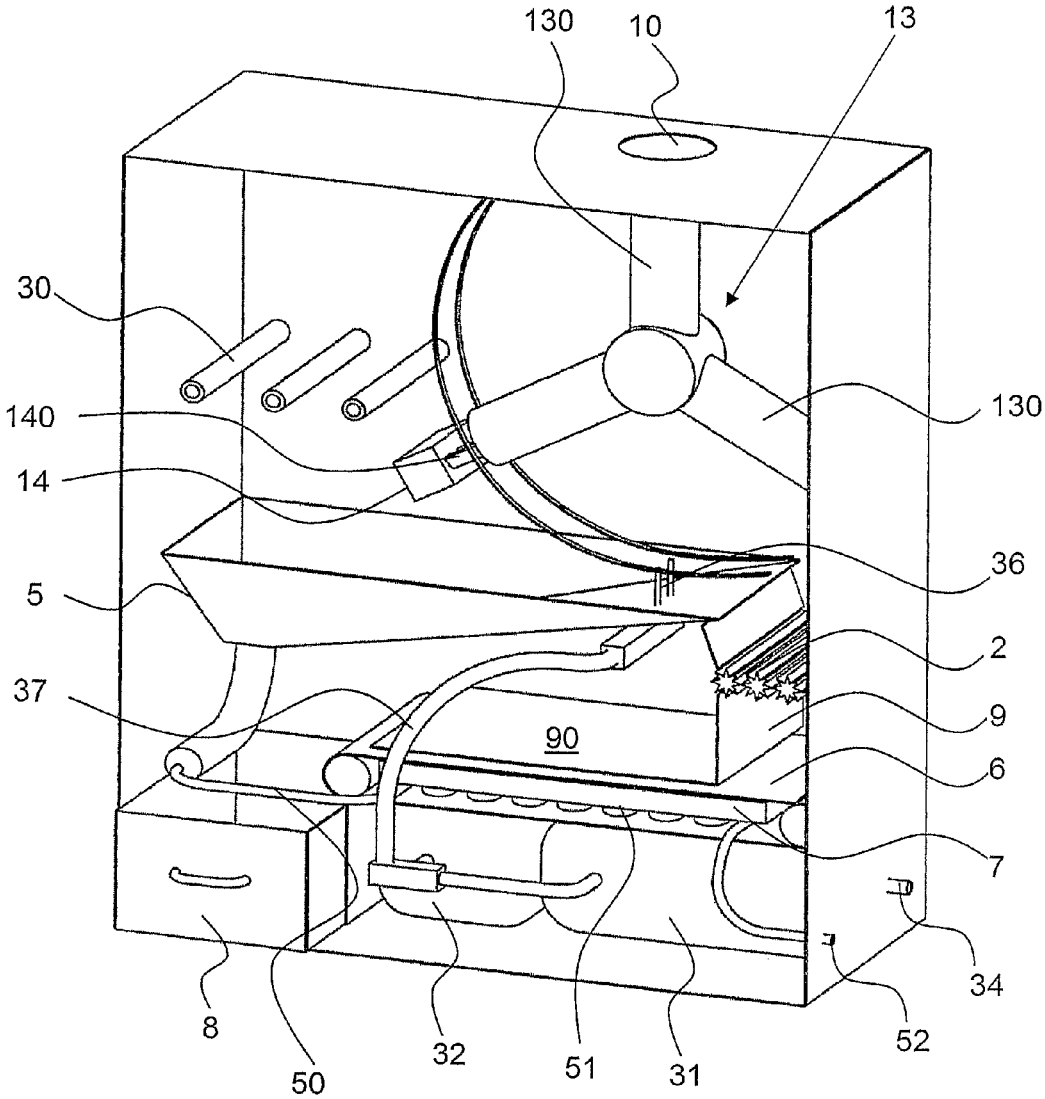
FIG. 4 shows a schematic perspective representation of the device according to the invention in a second embodiment.

In FIG. 4, a second embodiment of the device according to the invention is represented. The bags requiring disposal are again thrown into the housing 1 via a filling opening 10. If it is a bag with a rigid cover, the bag is preferably thrown in with the bag foremost. Underneath the filling opening 10 there is a rotary star 13 with a number of rotary arms 130, here three arms. The axis of rotation runs in a horizontal direction. Each rotary arm 130 is formed as a hollow cylinder, wherein its inside diameter preferably corresponds to, or is slightly smaller than, the diameter of the cover of the container, in order that the cover is held in the hollow cylinder.

In one rotational position of the rotary star there is a piercing unit 14 with one or more projecting piercing spikes 140. These piercing spikes 140 pierce into the bag located in the rotary arm 130, preferably into the cover, and thereby open the bag. The cover may have corresponding predetermined breaking points, so that predefined outlet openings in the cover are opened. The liquid can escape and falls into the liquid collecting basin 5 arranged thereunder, where it is directed, as in the first exemplary embodiment, via the outflow line 50 and the cleaning section 51 to the outlet opening. Above the fluid collecting basin 5 there are once again preferably upper spraying elements 30. Lower spraying elements, as in the first example, are not provided.

The pierced-open bag, still located in the rotary arm 130, is turned further and, in a further rotational position, is flushed out. Present for this purpose are upwardly directed nozzles 36, which are connected by means of a second feed line to the additive tank 32 or directly to the boiler 31.

In a further rotational position, the bag is then thrown out from the rotary arm 130. This may take place, for example, purely by gravitational force, in that the rotary arm points vertically downward, or the rotary arm may have a mechanical ejecting element, or the bag is forced out by compressed air.

The bag then reaches the chopper 2 and is comminuted there. Subsequently, it falls onto the second conveyor 6, is made to pass along the decontamination unit, here the gamma source 7, and in this way goes into the drawer 8. A first conveyor, as in the first example, is not provided.

The chopper 2 is preferably provided at the side with a guard plate 9, which prevents the cut-up parts of the bag from flying around too much in the interior space of the housing 1. A covering preferably also extends over the second conveyor 6, so that the parts of the bag are kept on the conveyor 6. This covering is in this example a leg 90 of the angled guard plate 9.

Figure 5:
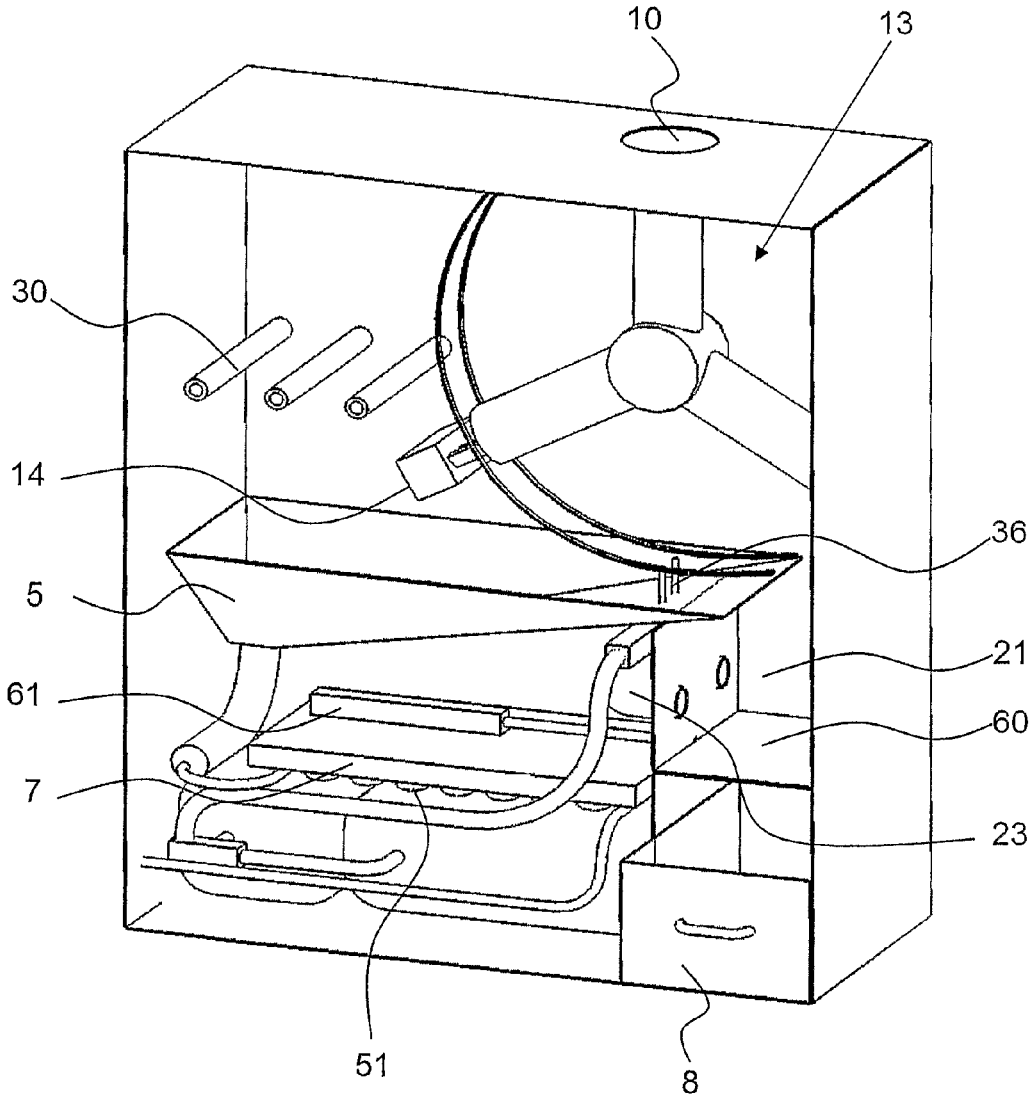
FIG. 5 shows a schematic perspective representation of the device according to the invention in a third embodiment.

The third embodiment according to FIG. 5 differs from the second in that there is a melting chamber 21 instead of a chopper 2 for comminuting the bag. The melting chamber 21 may be of an open or closed form. Here, it is open at the top and has at the bottom a baseplate 60, which can be opened by means of a pusher 61. Instead of the horizontal movement, it could also be swung.

A hot-air fan 23 is mounted in the housing 1, or on the outside thereof, and makes it possible to heat up the melting chamber 1 strongly enough. It must be possible in this way for the chamber to be heated up so strongly that the bag located in it melts and is decontaminated. The melting chamber is consequently the decontamination unit for the bag. Customary temperatures are from 130 to 200° C. Each bag can be comminuted individually and then removed via the baseplate 60 into the drawer 8, or a number of bags may be collected in the melting chamber and melted together. Instead of hot air, heating coils, heating plates or similar means may be used for heating up the melting chamber.

As can be seen in FIG. 5, now neither of the conveyors is provided. There is also no need for any further decontamination of the bag. However, as before, the fluid is made to pass along a decontamination unit, here as before the gamma source 7.

Figure 6A:
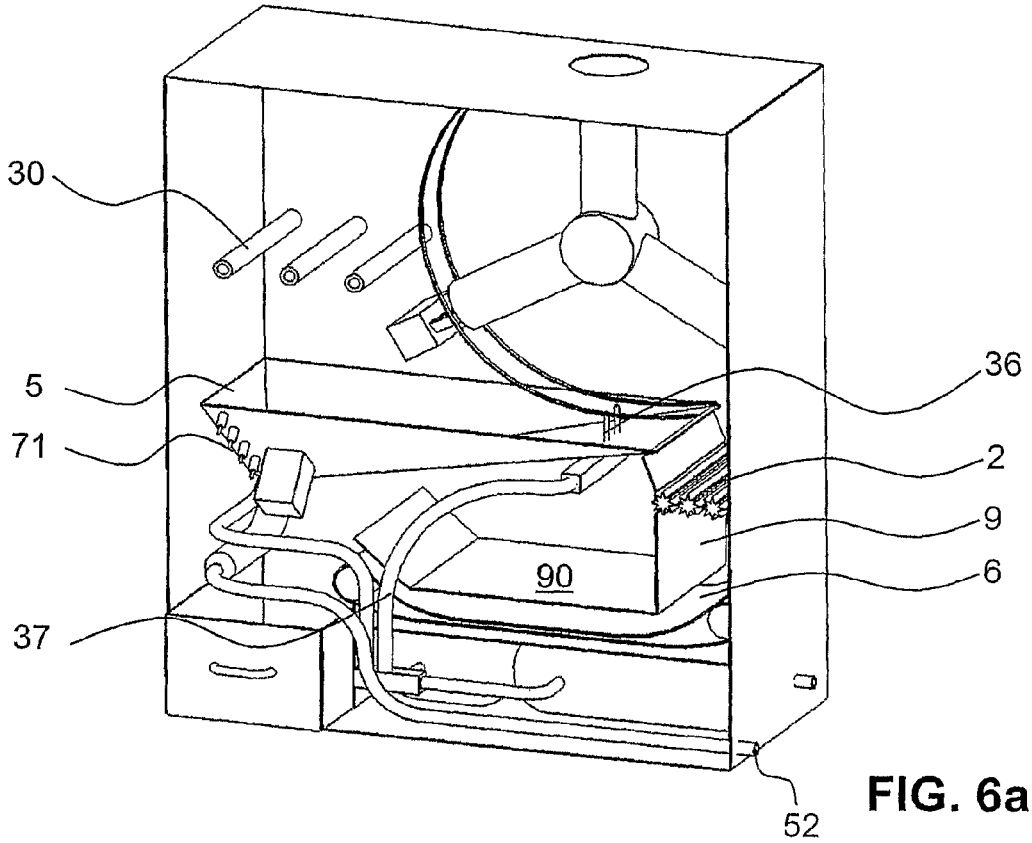
FIG. 6*a* shows a schematic perspective representation of the device according to the invention in a fourth embodiment.
Figure 6B:
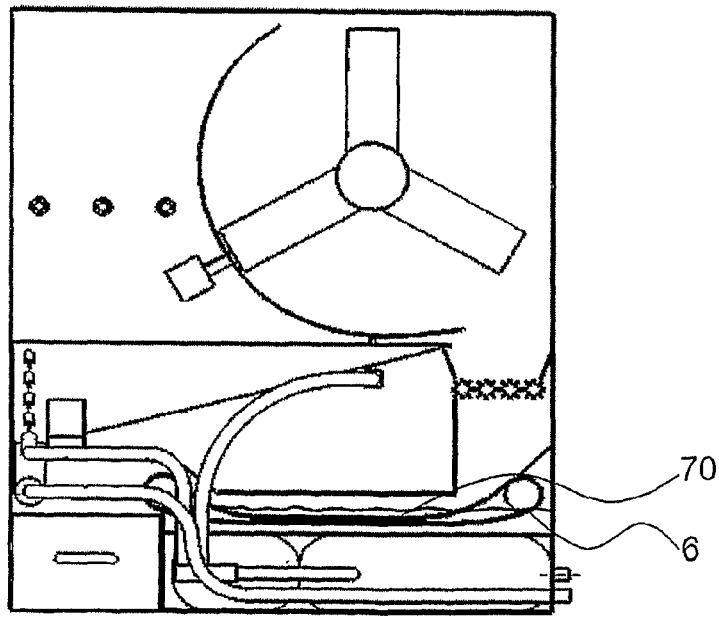
FIG. 6*b* shows a longitudinal section through the device according to FIG. 6*a;*

In the fourth embodiment according to FIGS. 6*a* and 6*b*, a chemical sterilization in the form of a wet antiseptic process is used instead of the gamma source. Wet cleaning nozzles 71 lead into the fluid collecting basin 5. They direct a chemical agent into the basin, so that the fluid is already sterilized in the basin. However, it can also be sterilized in a separate basin that is arranged downstream of the fluid collecting basin 5. Suitable as the chemical agent for this are, for example, iodine, iodophors, alcohol, formaldehyde, aldehydes, quaternary ammonium compounds, peracids, peroxides and phenols.

The cut-up bag falls from the chopper 2 into a disinfecting or cleaning bath 70, from where it passes to the particle collecting container 8, for example by means of the second conveyor 6, which leads through the cleaning bath 70. The same chemical agents as stated above can be used in the cleaning bath.

Figure 7A:
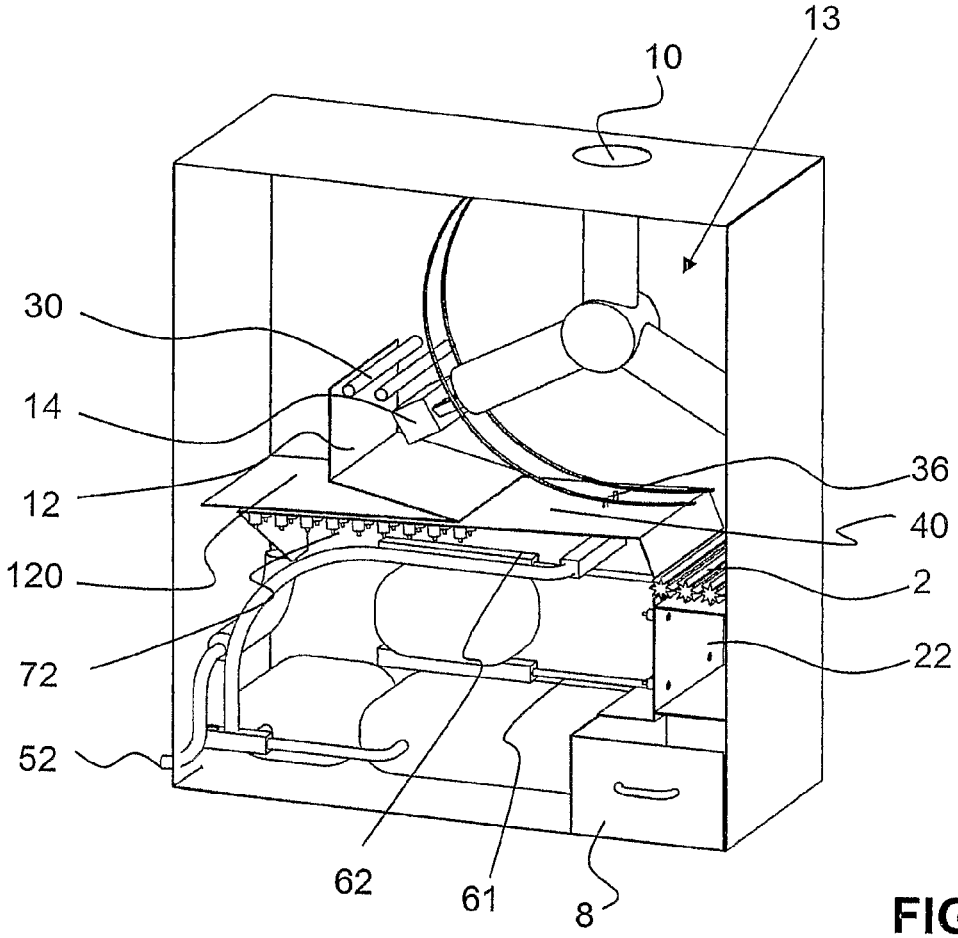
FIG. 7*a* shows a schematic perspective representation of the device according to the invention in a fifth embodiment and FIG. 7*b* shows a longitudinal section through the device according to FIG. 7*a*.
Figure 7B:
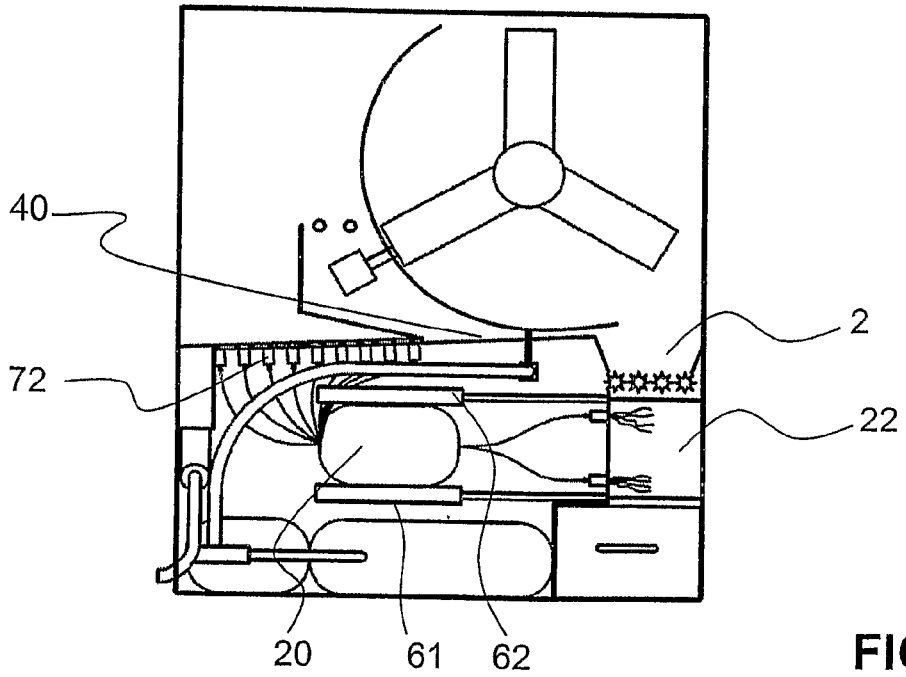

In contrast to FIGS. 6*a* and 6*b*, in the fifth exemplary embodiment according to FIGS. 7*a* and 7*b* a dry antiseptic process is carried out. The fluid requiring disposal flows out of the pierced-open bag along the angled baffle 12 onto a sloping plate 40. The baffle 12 has a covering leg 120, which covers over the sloping plate 40. Arranged underneath this sloping plate 40 are dry cleaning nozzles 72, which subject the fluid requiring disposal to a dry cleaning agent through openings or pores in the plate 40. Suitable as the dry cleaning agent is, for example, a gas such as ethylene oxide or formaldehyde gas. At the end of the plate 40, the decontaminated fluid is made to pass via a basin or a funnel to the outlet opening 52.

Here, too, the emptied bag is comminuted by means of the chopper 2 and decontaminated in a decontamination chamber 22. The bag is preferably subjected to a gas, wherein the gas container 20 may once again be mounted in the housing 1 or on the outside thereof. The chamber 22 preferably has once again a base 60, which can be removed by means of a pusher 61 or otherwise swung up or opened. As a result, the comminuted bag reaches the particle collecting container 8.

Consequently, a wide variety of modifications of the devices according to the invention and of the methods according to the invention are possible. The examples mentioned above may be combined with one another as desired. For example, in all the devices there may be a chopper and/or a melting chamber. Instead of only one type of decontamination, two or more may be used, in particular arranged one after the other. Further examples are:

The bag may already be emptied before it is cut up into pieces. This emptying may also already take place outside the housing 1, in a device that is separate therefrom. Disposal of the body fluid takes place separately and the device according to the invention is only used for the disposal of the bag and the residual body fluid present in it.

The decontamination may also take place with the bag filled, and the bag is only emptied and cut up into pieces subsequently.

The collected fluid and the cut-up bag are decontaminated separately from each other and by different decontaminating agents or methods.

The cleaning unit cleans only the cut-up bag or only the still not cut-up bag or the cleaning unit alternatively or additionally cleans the interior of the still not cut-up bag.

There is also at least one decontamination unit in the region of the first conveyor, or the entire interior of the housing is irradiated, heated up or otherwise used for the decontamination.

LIST OF DESIGNATIONS

1 housing
10 filling opening
11 filling funnel
12 baffle

120 covering leg
13 rotary star
130 rotary arm
14 piercing unit
140 piercing spike
2 chopper
20 gas container
21 melting chamber
22 dry decontamination chamber
23 hot-air fan
3 flushing unit
30 upper spraying elements
30' lower spraying elements
31 boiler
32 additive tank
33 connecting line
34 filling opening
35 feed line
36 nozzles
37 second feed line
4 first conveyor
40 sloping plate
5 fluid collecting basin
50 outflow line
51 cleaning section
52 outlet opening
6 second conveyor
60 baseplate
61 first pusher
62 second pusher
7 gamma radiation source
70 cleaning bath
71 wet cleaning nozzles
72 dry cleaning nozzles
8 particle collecting container
9 guard plate
90 covering leg

The invention claimed is:

1. A disposal device for body fluid collecting bags, wherein the device has a receptacle for receiving at least one collecting bag comprising body fluid, a comminution unit for comminuting the collecting bag, a particle collecting container for receiving the comminuted collecting bag and at least one decontamination unit for the decontamination of the collecting bag and the body fluid.

2. The disposal device as claimed in claim 1, wherein it also has a fluid collecting basin for receiving the body fluid.

3. The disposal device as claimed in claim 1, wherein the decontamination unit comprises at least one of the following means: a gamma radiation source, a UV light source, a heating unit, a flame-treatment unit, a wet antiseptic unit, a dry antiseptic unit, a sterile filtration.

4. The disposal device as claimed in claim 1, wherein the same decontamination unit can be used for the simultaneous but separate treatment of the cut-up collecting bag and the collected body fluid.

5. The disposal device as claimed in claim 1, wherein it has a flushing unit for cleaning the still not cut-up and/or the cut-up collecting bag.

6. The disposal device as claimed in claim 2, wherein it has at least one fluid-permeable conveyor for conveying the cut-up collecting bag, wherein the fluid collecting basin is arranged under this conveyor.

7. The disposal device as claimed in claim 1, wherein the decontamination unit is arranged along a conveying section for the cut-up collecting bag and along a conveying section for the body fluid.

8. The disposal device as claimed in claim 7, wherein the conveying section for the cut-up collecting bag and the conveying section for the body fluid run parallel to each other and preferably one under the other.

9. The disposal device as claimed in claim 7, wherein the conveying section for the body fluid runs in a meandering form.

10. The disposal device as claimed in claim 7, wherein the conveying section for the cut-up collecting bag is formed by a continuously circulating conveyor belt.

11. The disposal device as claimed in claim 1, wherein the decontamination unit for the decontamination of the bag comprises a melting chamber.

12. The disposal device as claimed in claim 1, wherein the decontamination unit for the decontamination of the fluid comprises a sloping plate which can be subjected to a dry antiseptic.

13. A disposal device for body fluid collecting bags, wherein the device has a receptacle for receiving at least one collecting bag comprising body fluid, a fluid collecting basin for receiving the body fluid and at least one decontamination unit for the decontamination of the body fluid.

14. A method for the disposal of a body fluid collecting bag, with the following steps:

comminuting the collecting bag, collecting the body fluid separately from the comminuted collecting bag and decontaminating the collecting bag and the body fluid.

15. The method as claimed in claim 14, wherein the collecting bag is cut up into pieces before its decontamination and wherein the cut-up collecting bag is separate from the body fluid during the decontamination.

16. The method as claimed in claim 14, wherein the collecting bag is melted or incinerated for the purpose of comminution and decontamination and wherein the body fluid is decontaminated separately from the collecting bag.

17. The method as claimed in claim 14, wherein the body fluid is removed from the collecting bag before the comminution of the latter.

18. The method as claimed in claim 14, wherein the emptied collecting bag is flushed with a disinfecting solution.

19. The method as claimed in claim 14, wherein the decontamination of the bag and/or of the fluid comprises at least one of the following treatments: irradiation with gamma rays, irradiation with UV rays, heating up, flame exposure, a wet or dry antiseptic process, sterile filtration.

20. The method as claimed in claim 14, wherein the collecting bag is pierced open for emptying.

21. The method as claimed in claim 14, wherein the collecting bag is cut up into pieces in the state in which it is filled with the body fluid.

* * * * *